United States Patent [19]

Ralston, Jr.

[11] 3,983,025

[45] Sept. 28, 1976

[54] APPARATUS FOR REGULATING ANODE-CATHODE SPACING IN AN ELECTROLYTIC CELL

[75] Inventor: Richard W. Ralston, Jr., Cleveland, Tenn.

[73] Assignee: Olin Corporation, New Haven, Conn.

[22] Filed: July 18, 1974

[21] Appl. No.: 489,648

Related U.S. Application Data

[63] Continuation-in-part of Ser. No. 272,240, July 17, 1972, abandoned.

[52] U.S. Cl. ..... 204/225; 204/99; 204/128; 204/228

[51] Int. Cl.[2] ..... C25D 17/00; C25D 21/12; C25B 1/40

[58] Field of Search ..... 204/99, 225, 219, 250, 204/228, 245

[56] References Cited

UNITED STATES PATENTS

| | | | |
|---|---|---|---|
| 3,531,392 | 9/1970 | Schmeiser | 204/225 |
| 3,723,285 | 3/1973 | Daga et al. | 204/228 |
| 3,763,024 | 10/1973 | Engelmann et al. | 204/1 R |

FOREIGN PATENTS OR APPLICATIONS

| | | | |
|---|---|---|---|
| 1,804,259 | 5/1970 | Germany | 204/99 |
| 1,212,488 | 11/1970 | United Kingdom | 204/225 |

*Primary Examiner*—John H. Mack
*Assistant Examiner*—Aaron Weisstuch
*Attorney, Agent, or Firm*—Donald F. Clements; James B. Haglind; Thomas P. O'Day

[57] ABSTRACT

An improved method and apparatus for adjusting the space between an adjustable anode and a cathode in an electrolytic cell wherein current measurements and voltage measurements are obtained and compared with predetermined standards. Measurement of deviation from the predetermined standards are used to determine the direction of anode adjustment. A digital computer operably connected to motor drive means adapted to raise or lower anode sets upon appropriate electric signals from the computer is a preferred embodiment of this invention.

9 Claims, 3 Drawing Figures

APPARATUS FOR REGULATING ANODE-CATHODE SPACING IN AN ELECTROLYTIC CELL

This application is a continuation-in-part of copending application Ser. No. 272,240, filed July 17, 1972, now abandoned.

The present invention relates to a method and apparatus for adjusting the anode-cathode spacing in an electrolytic cell. In particular, the invention relates to an improved method and apparatus for adjusting the anode-cathode spacing in electrolytic mercury cells for the electrolysis of alkali metal chlorides such as sodium chloride.

In electrolytic cells with adjustable anodes, the control of the inter-electrode distance between the anode and the cathode is economically important. The anode-cathode spacing should be narrow to maintain the voltage close to the decomposition voltage of the electrolyte. Careful control of the anode-cathode spacinng reduces energy lost in the production of heat and reduces short circuiting and its accompanying problems which include the destruction of anode surfaces and the contamination of the electrolytic products.

Numerous techniques have been developed to adjust the anode-cathode gap in electrolytic cells. For example, U.S. Pat. No. 3,574,073, issued Apr. 6, 1971, to Richard W. Ralston, Jr., discloses adjustment means for anode sets in electrolytic cells. In this patent, a means responsive to changes in the flux of the magnetic field generated by electrical flow in a conductor supplying the anode sets controls the opening and closing of an electrical circuit, and activates hydraulic motors which are effective to raise or lower the anode sets. In addition, a cell voltage signal and a temperature compensated amperage signal proportional to the bus bar current for the anode set are fed as input to an analog computer which produces an output reading of resistance calculated according to the formula:

$$R = \frac{E - E_r}{I}$$

where $R$ is the resistance of one anode set, $E$ is the cell voltage, $E_r$ is the reversible potential of the particular electrode-electrolyte system and $I$ is the current flowing to the anode set. Each anode set has a characteristic resistance at optimum efficiency to which that anode set is appropriately adjusted.

U.S. Pat. No. 355,454, which issued Jan. 26, 1971, to Rolph Schafer et al., discloses the regulation of voltage in an electrolytic cell be measuring the cell voltage and comparing it with a reference voltage. The gap between electrodes is changed in accordance with deviations between the measured voltage and the reference voltage and all electrodes in the cell are adjusted as a unit.

Similarly, U.S. Pat. No. 3,627,666, which issued Dec. 14, 1971, to Rene L. Bonfils, adjusts all electrodes in an electrolytic cell using apparatus which measures the cell voltage and current in a series of circuits which regulate the anode-cathode gap by establishing a voltage proportional to $U - RI$ where $U$ is the cell voltage, $I$ the cell current and $R$ the predetermined resistance of the cell.

A method of adjusting electrodes by measuring the currents to individual electrodes in cyclic succession and adjusting the spacing for those anodes whose measured currents differ from a selected range of current values is disclosed in U.S. Pat. No. 3,531,392, which issued Sept. 29, 1970, to Kurt Schmeiser. All electrodes are adjusted to the same range of current values and no measurement of voltage is made.

A method of detecting incipient short circuiting is disclosed in U.S. Pat. No. 3,361,654, which issued Jan. 2, 1968, to D. Deprez et al., by advancing an anode an unknown distance toward the cathode, measuring current as the anode moves and stopping movement of the anode when the current of the cell undergoes a rapid increase disproportionate to the speed of anode advancement, and then reversing the direction of anode movement a selected distance. This method adjusts the electrode with respect to the cell current.

West German Patent No. 1,804,259, published may 14, 1970, and East German Patent No. 78,557, issued Dec. 20, 1970, also describe techniques for adjusting the gap between anodes and cathodes.

While the above methods provide ways of adjusting the anode-cathode spacing in an electrolytic cell, it is well known that in a cell containing a plurality of electrodes, the optimum anode-cathode spacing for a particular electrode will depend on its location in the cell, and its age or length of service, among other factors. For example, in a horizontal mercury cell for electrolyzing alkali metal chlorides, the optimum anode-cathode spacing for an anode located near the entry of the cell is different from the spacing for one located near the cell exit. In addition, decomposition voltage varies throughout the cell as brine temperature and concentration change. Likewise a new anode can maintain a closer anode-cathode spacing than one which has been in the cell for a longer period of time or can operate more efficiently at the same spacing. In addition, after an anode has been lowered it is necessary to know whether the anode-cathode spacing is too narrow, which may cause short circuiting or loss of efficiency.

There is a need at the present time for an improved method and apparatus for controlling the space between an adjustable anode and a cathode which utilizes current measurements, and/or voltage measurements or a combination thereof to effect adjustment of the electrode space of individual anode sets under the varying conditions occurring in the aforesaid electrolytic cells.

It is an object of this invention to provide an improved method and apparatus for adjusting anode-cathode spacing in an electrolytic cell which overcome disadvantages in previously known techniques for adjusting this spacing.

Objects of this invention are accomplished in an apparatus for adjusting the space between electrodes in an electrolytic cell, said electrodes being comprised of at least one adjustable anode set and a liquid cathode in spaced relationship, said apparatus comprising in combination:

a. digital computer means programmed with predetermined standard signal ranges for voltage signals and current signals for each of said anode sets,
b. means for detecting voltage signals and current signals to each anode set,
c. means for selecting from said detected signals a set of signals generated from a selected anode set,
d. means for supplying said selected signals to said digital computer means, e. means for comparing said selected signals with said predetermined standard signal ranges for said selected anode set programmed in said computer, f. means in said digital computer for generating activating electric signals when said detected signals are outside of said predetermined standard signal ranges, and g. motor means operative to raise and lower said selected anode set, said motor means being energized by said activating electric signals when said detected signals are outside said standard signal ranges.

In preferred embodiments the apparatus of this invention also has in combination:

h. means for reactivating said means a. through g. immediately after said motor means is activated to lower said anode set, i. means for storing the previously detected signals obtained prior to lowering said selected anode set and means for comparing newly detected signals with said previously detected signals, j. means for detecting analog type voltage signals produced by each conductor carrying current to each anode set, k. means for compensating said signals for temperature variations in said conductors to produce signals that are proportional to the current flow in said conductor, l. means for detecting analog type voltage signals across said anode set, m. means for selecting from said compensated signals a set of signals generated from the conductors carrying current to a selected anode set in said electrolytic cell, n. means for amplifying said set of signals, o. means for transforming the thus amplified set of signals at cell potential into proportional signals at computer potential, p. means for conditioning said proportional signals to remove rectifier-generated noise, q. means for converting the thus conditioned signals of the analog type to signals of the digital type, r. means for calculating the voltage coefficient from said digital type signal according to the formula:

$$\text{Voltage coefficient} = \frac{V - D}{KA/M^2}$$

where V is the overall voltage across said anode set in which said set of signals is generated, D is the decomposition voltage of the cell, and $KA/M^2$ is the current density in kiloamperes per square meter of cathode surface below said selected anode set, s. means for comparing the thus calculated voltage coefficients with a predetermined voltage coefficient for said anode set in said cell and determining the difference between said calculated voltage coefficient and said predetermined voltage coefficient, t. means for comparing the digital type current signals with a predetermined current for each anode set in said cell and determining the difference between said measured current and said predetermined current, u. motor means operative to raise and lower by a predetermined amount said anode set fed by the conductor in which said signals are detected, said motor means being energized by electric signals from said computer to raise said anode set when said calculated voltage coefficient is below said predetermined voltage coefficient by an amount in excess of $k$, a predetermined limit, or said measured current is higher than said predetermined current, and said differences exceed a predetermined limit, and said motor means being energized to lower said anode set when said calculated voltage coefficient is higher than said predetermined voltage coefficient by more than said $k$, v. means for activating said means ($j$) through ($q$) immediately after said motor means is activated to lower said anode set and means for comparing the new signals proportional to current flow in the conductor feeding said anode set with the signals proportional to current flow to said anode set prior to lowering said anode set, w. means for activating said motor means to raise said anode set by a predetermined amount when the increase in current following said lowering of the said anode set exceeds a predetermined amount, x. means for activating said means ($a$) through ($h$) when the increase in current is less than said predetermined amount, but continues to increase unless said current exceeds a second predetermined limit; means for activating said motor means to raise said anode set by a predetermined amount when the current exceeds said second predetermined limit, y. means for activating said motor means to raise said anode set by a predetermined amount when said current continues to increase for longer than a predetermined period of time, and z. means for activating said motor means to raise said anode set a predetermined amount when fluctuations in a plurality of measurements of current flow exceeds a predetermined limit.

In the novel method of this invention, an electrolytic cell is used containing an electrolyte decomposable by electric current, said electrolyte being in contact with electrodes comprised of at least one adjustable anode set and a liquid cathode spaced apart a predetermined distance. A voltage is applied to the cathode and anode set to develop an electric current flow through said electrolyte to effect decomposition thereof. In the operation of this electrolytic cell, the improved method of this invention comprises:

A. operably connected to the adjustable anode set a motor drive means adapted to raise and lower the adjustable anode set upon receipt of electric signals from a digital computer, B. obtaining N current measurements of the current to the anode set over a predetermined period, and conveying each current measurement by electric signal to the computer, C. comparing in the computer each current measurement with a preceding current measurement and determining the difference in current, and D. conveying an electric signal from the computer to the motor drive means to increase the space a predetermined distance when the difference in current is an increase which exceeds a predetermined limit.

In another embodiment of the invention, the improved method of this invention also comprises:

E. measuring the current to the anode set and conveying the current measurement by electric signal to the computer, F. conveying an electric signal from the computer to the motor drive means to decrease the space between the anode set and the cathode by a predetermined distance, and after decreasing the space, G. obtaining N current measurement of the current to the anode set over a predetermined period, and conveying each current measurement by electric signal to the computer, H. comparing in the computer, each current measurement with a preceding current measurement and determining the difference in current, and I. conveying an electrical signal from the computer to the motor drive means to increase the space a predetermined distance when the difference in current is an increase which exceeds a predetermined limit.

The difference in current may be determined between any two successive current measurements or between any current measurement and a preceding current measurement during the same predetermined period or a preceding predetermined period. In addition, the difference in current may be determined between any current measurement for the anode set and an average anode set current based upon the bus current for the entire cell. Similar adjustments in the space are made when the average difference or the square root of the average of the squares of the differences in current measurements exceed predetermined limits.

In another embodiment a standard or set-point voltage coefficient, S, is determined for each anode set and subsequent calculations of the voltage coefficient are made and compared with the standard S. When the difference between the calculated voltage coefficient exceeds a predetermined limit above the standard voltage coefficient, S, the space is decreased a predetermined distance. When the calculated voltage coefficient exceeds a predetermined limit, below the standard S the space is increased and examination of the anode set is made to determine the cause of the problem.

The method and apparatus of the present invention provides for the adjustment of the anode-cathode spacing for individual anode sets in an electrolytic cell where the optimum anode-cathode spacing may vary for all anode sets in a cell. In addition, the selection of cells and anode sets within a cell for possible adjustment may be made randomly or in order.

The method and apparatus of this invention are particularly useful in controlling commercial electrolytic cells where large numbers of cells are connected in series and each cell contains a plurality of anode sets.

Figure 1:
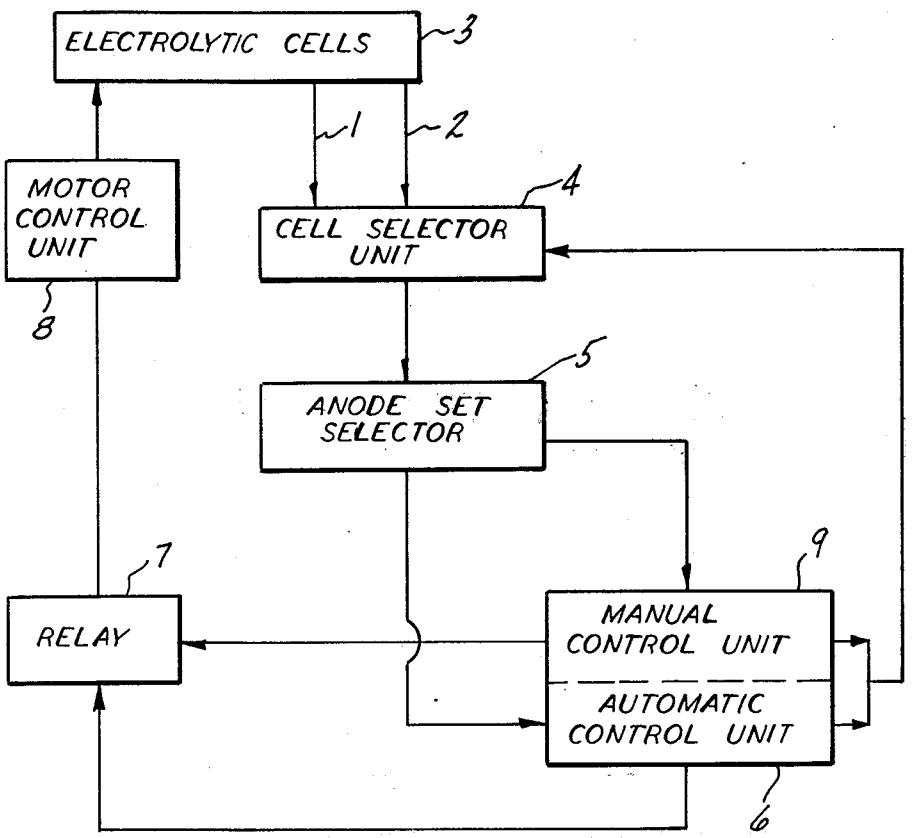
FIG. 1 is a block diagram showing generally the layout of the apparatus of this invention.

FIG. 1 illustrates the apparatus of this invention in block diagram form where electric signals representing current measurements 1 and electric signals representing voltage measurements 2 from each anode set (not shown) for each electrolytic cell 3 are selected by cell selector unit 4. Anode set selector unit 5 in response to a signal from manual control unit 9 selects electric signals for current measurements 1 and voltage measurements 2 from any desired anode set in electrolytic cell 3 through cell selector unit 4. Automatic control unit 6 transmits signals to cell selector unit 4 to select current measurements 1 and voltage measurements 2 from cell selector unit for desired anode sets and performs the required calculations and comparisons with predetermined limits. when these calculations and comparisons show that raising or lowering of the anode set is necessary, appropriate electric signals are conveyed to relay 7, then to motor control unit 8 which operates upon the anode adjustment mechanism (not shown) to raise or lower the anode set. Motor control unit 8, which can be used for increasing or decreasing the anode-cathode spacing in any anode set in electrolytic cell 3, can also be controlled by manual control unit 9 through anode set selector unit 5.

Figure 2:
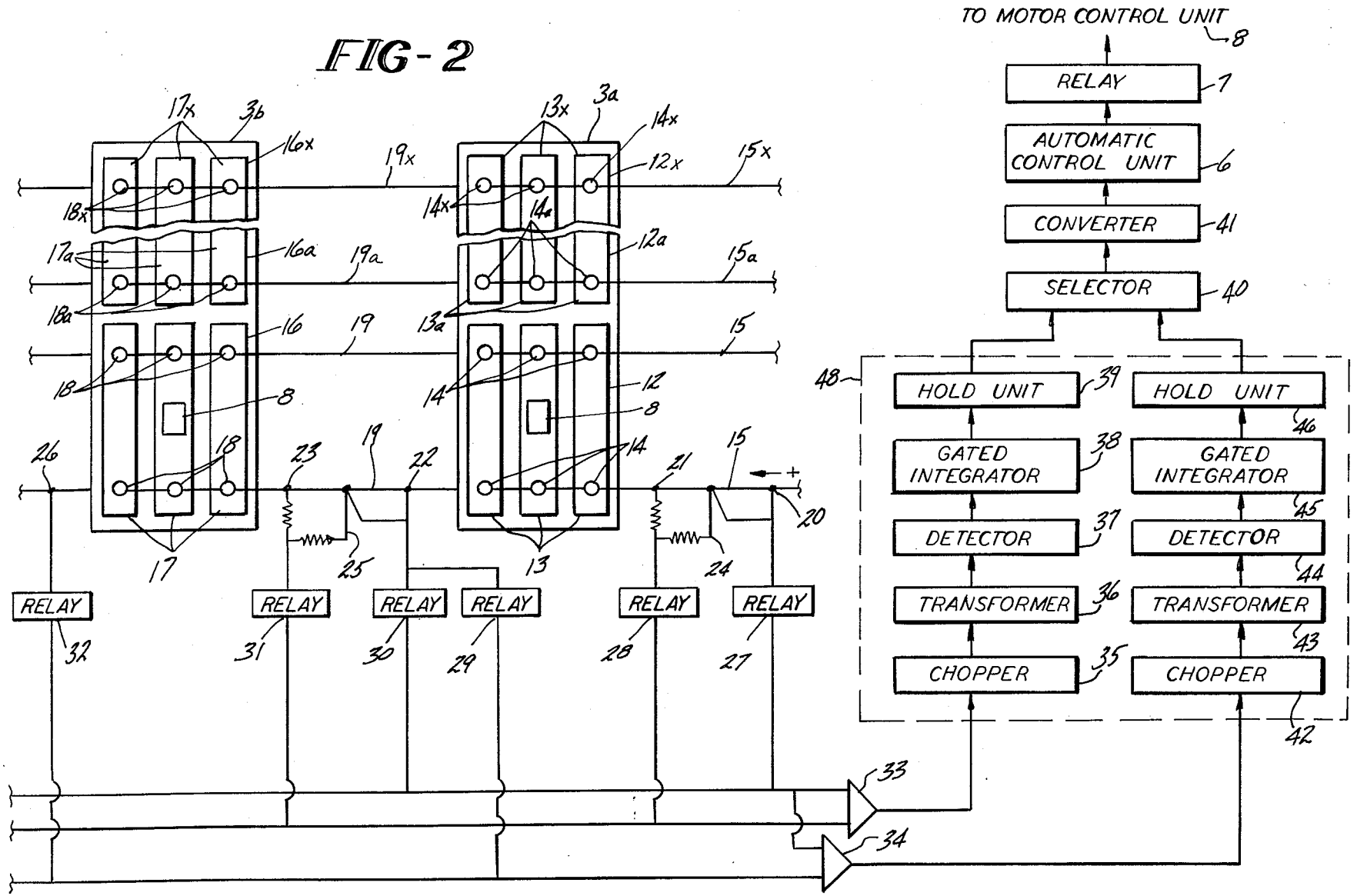
FIG. 2 is a block diagram showing one embodiment of the invention including a signal isolation and signal conditioning system utilizing a transformer.

FIG. 2 is a block diagram showing one embodiment of the signal selection and conditioning system for two adjacent electrolytic cells 3*a* and 3*b*, respectively, in series.

Electrolytic cell 3*a* has a plurality of anode sets 12, 12*a* and 12*x*. Anode set 12 is comprised of at least one anode 13, for example three parallel anodes 13. Each anode 13 is provided with at least one anode post 14, and with two anode posts 14 preferably, as shown, with the anode posts 14 arranged in two parallel rows. A conductor 15 is connected to each row of anode posts 14 in electrolytic cell 3*a*. Current from plant supply (not shown) is conveyed through two conductors 15 to each row of anode posts 14 in anode set 12. Anode sets 12*a* and 12*x* are each comprised of three anodes, 13*a* and 13*x*, respectively, having two rows of anode posts 14*a* and 14*x*, respectively, secured to conductors 15*a* and 15*x*, respectively.

Adjacent electrolytic cell 3*b* has a corresponding number of anode sets 16, 16*a* and 16*x*. Anode set 16 is comprised of three parallel anodes 17 having two rows of anode posts 18 in each anode set 16. Anode sets 16*a* and 16*x* each have three parallel anodes 17*a* and 17*x* with two rows of anode posts 18*a* and 18*x*.

Current from anode posts 14 of electrolytic cell 3*a* passes to anodes 13, through the electrolyte (not shown), the mercury amalgam (not shown) to the bottom of electrolytic cell 3*a*.

Conductors 19 connect to terminals (not shown) at the bottom of electrolytic cell 3*a* at points adjacent to the nearest anode 13 and convey current to the corresponding rows of anode posts 18 in electrolytic cell 3*b*. In a similar manner, current passes from anode post 14*a* and 14*x*, respectively, to anodes 13*a* and 13*x*, respectively, through the electrolyte and the mercury cathode to the bottom of electrolytic cell 3*a*. Conductors 19*a* and 19*x* convey current from terminals positioned in the bottom of electrolytic cell 3*a* at points adjacent to the nearest anode 13*a* and 13*x*, respectively, to the corresponding anode posts 18*a* and 18*x*, respectively, in electrolytic cell 3*b*.

The voltage drop between terminals 20 and 21 on conductor 15 is measured to obtain an electrical signal which is proportional to the current flow to anode set 12. Similarly, the voltage drop between terminals 22 and 23 on conductor 19 is measured to obtain an electric signal which is proportional to the current flow to anode set 16.

The distance between terminals 20 and 21 is the same as the distance between terminals 22 and 23. The current signals from these terminals are transmitted to thermistor circuits 24 and 25, respectively, where the current signals are temperature compensated. Current signals from thermistor 24 are transmitted across relay circuits 27 and 28 to amplifier 33 and current signals from thermistor 25 are transmitted across relay circuits 30 and 31 to amplifier 33.

The voltage drop across anode set 12 in electrolytic cell 3*a* is measured between terminals 20 and 22 and the voltage drop across anode set 16 in electrolytic cell 3*b* is measured between terminals 22 and 26. Electric signals representing the voltage drop across anode set 12 are conveyed across relay circuits 27 and 29 to amplifier 34 and electric signals representing the voltage drop across anode set 16 are conveyed across relay circuits 30 and 32 to amplifier 34.

The same current signals and voltage signals are obtained for the other conductor 15 to anode set 12 as well as all of the other conductors 15*a*, 15*x*, 19, 19*a*, and 19*x*. Thus, for an electrolytic cell containing 10 anode sets, each anode set having two rows of anode posts connected to the anodes in the set, there are 20 conductors, each providing a current signal to a separate amplifier 33 and a voltage signal to a separate amplifier 34.

Temperature compensated current signals are amplified in amplifier 33 and conveyed to chopper 35 in signal isolation and conditioning system 48 where they are converted from direct current signals to alternating current signals. These signals are then transmitted at cell potential to transformer 36 having one terminal of the primary winding connected to cell potential and one terminal of the secondary winding connected to earth potential. The current signals are isolated in transformer 36 and leave at earth potential in order to be compatible with automatic control unit 6. The current signals are transmitted from transformer 36 to detector 37 where the isolated current signals are converted from alternating current signals to direct current signals, and the resulting direct current signals are transmitted to a gated integrator 38 where rejection of electrical noise, particularly that generated by the rectifier which supplies current to electrolytic cells 3*a* and 3*b*. Noise conditioned current signals are transmitted to hold unit 39 (capacitor) and stored until selected by selector 40.

In a similar manner, the voltage signals are amplified in amplifier 34 and conveyed to a chopper 42, then at cell potential are conveyed to a transformer 43, where the voltage signals are isolated and leave at earth potential. These signals are converted from alternating to direct current in detector 44 and then to gated integrator 45 where rejection of electrical noise is also effected. The resulting voltage signals are transmitted to hold unit 46, (capacitor) where they are stored until selected by selector 40 in the same manner as current signals stored in hold unit 39. In response to a programmed electric signal from automatic control unit 6, (or if desired, an electric signal initiated manually from manual control unit 9 of FIG. 1), current signals and voltage signals from selector 40 for any desired anode set such as anode set 12 or 16 are selected and transmitted to convertor 41 where they are converted from analog form to binary form and then transmitted to automatic control unit 6 for processing. In automatic control unit 6, the selected signals are compared with predetermined values and when necessary, the selected anode set is raised or lowered by an appropriate electric signal from automatic control unit 6 through relay 7 to motor drive 8, which operates to raise or lower the selected anode set.

Figure 3:
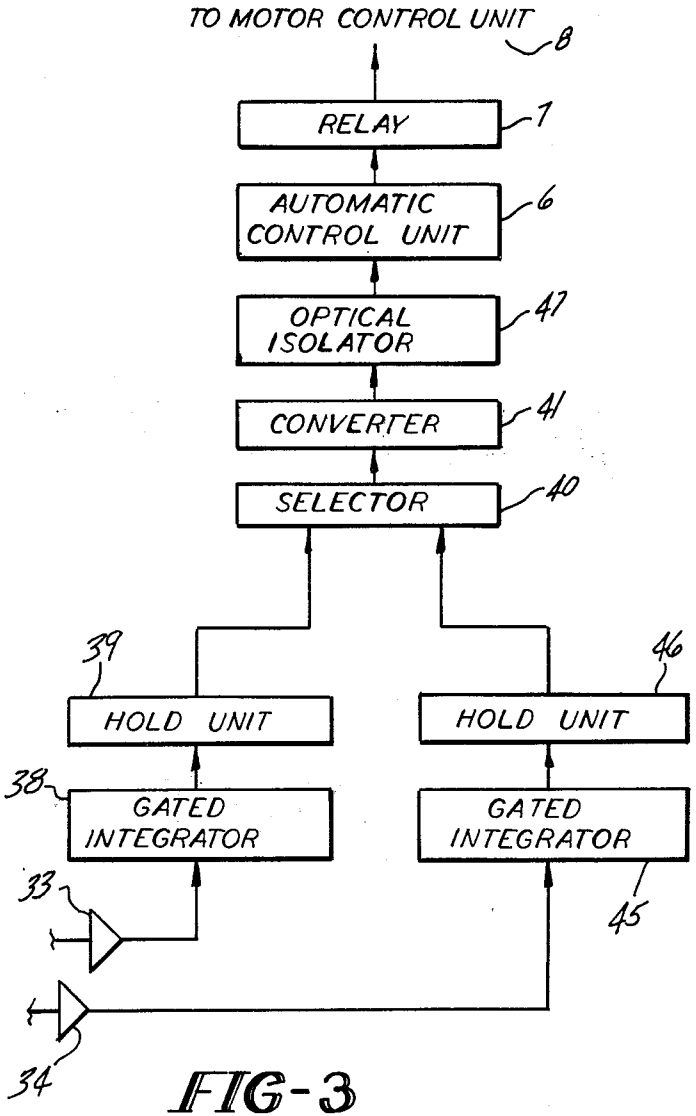
FIG. 3 is a block diagram showing another embodiment of the invention including a signal isolation and signal conditioning system utilizing an optional isolator.

FIG. 3 shows another embodiment of the invention utilizing an optical isolator. In FIG. 3, temperature compensated current signals from amplifier 33 in FIG. 2 are conveyed to gated integrator 38 where rejection of electrical noise, particularly that generated by the rectifier which supplies current to electrolytic cells 3*a* and 3*b*, is effected. Noise conditioned current signals are transmitted to hold unit 39 and stored until selected by selector 40.

In a similar manner, voltage signals from amplifier 34 of FIG. 2 are conveyed in FIG. 3 to a gated integrator 45 where rejection of electrical noise is also effected. The resulting voltage signals are transmitted to hold unit 46, where they are stored until selected by selector 40 in the same manner as current signals stored in hold unit 39. In response to a programmed electric signal from automatic control unit 6, or, if desired, a manually initiated electrical signal, current signals and voltage signals from selector 40 for any desired anode set are selected, the signals are transmitted to convertor 41 where they are converted from analog form to binary form and then transmitted to optical isolator 47.

Signals enter optical isolator 47 at cell potential, are isolated and transmitted at earth potential to automatic control unit 6, where the selected signals are compared with predetermined values, and when necessary the selected anode set is raised or lowered in the same manner as described for FIG. 2.

The method and apparatus of the present invention may be used on a variety of electrolytic cell types used for different electrolytes and electrolysis systems. The invention is particularly useful in the electrolysis of alkali metal chlorides to produce chlorine and alkali metal hydroxides. More particularly, the invention is especially suitable for use in combination with the anode adjusting mechanisms driven by an electric motor or the like operating on adjustable anodes positioned in horizontal electrolytic cells having a liquid metal cathode such as mercury, as disclosed, for example in U.S. Pat. Nos. 3,390.070 and 3,574,073, which are hereby incorporated by reference in their entirety.

As indicated in U.S. Pat. NO. 3,574,073, issued Apr. 6, 1971, to Richard W. Ralston, Jr., horizontal mercury cells usually consist of a covered elongated trough sloping slightly towards one end. The cathode is a flowing layer of mercury which is introduced at the higher end of the cell and flows along the bottom of the cell toward the lower end. The anodes are generally composed of slotted rectangular blocks of graphite or metal distributors having an anodic surface comprised of titanium rods or mesh coated with a metal oxide secured to the bottom of the distributor. Anode sets of different materials of constructions may be employed in the same cell, if desired. The anodes are suspended from at least one anode post such as a graphite rod or a protected copper tube or rod. Generally, each rectangular anode has two anode posts, but only one, or more than two, may be used, if desired. The anodes in each anode set are placed parallel to each other, the anode posts forming parallel rows across the cell. The bottoms of the anodes are spaced a short distance above the flowing mercury cathode. The electrolyte, which is usually salt brine, flows above the mercury cathode and also contacts the anode. Each anode post in one row of an anode set is secured to a first conductor, and the other row of anode posts is secured to a second conductor. Each conductor is adjustably secured at each end to a supporting post secured to the top of the cell. Each supporting post is provided with a drive means such as a sprocket which is driven through a belt or chain or directly by a motor such as an electric motor, hydraulic motor or other motor capable of responding to electric signals from automatic signal device 6.

Although the invention is particularly useful in the operation of horizontal mercury cells used in the electrolysis of brine, it is generally useful for any liquid cathode type electrolytic cell where adjustment of the anode-cathode space is necessary for efficient operation.

The number of electrolytic cells controlled by the method and apparatus of this invention is not critical. Although a single electrolytic cell can be controlled, commercial operations containing more than 100 cells can be successfully controlled.

Each electrolytic cell may contain a single anode, but it is preferred to apply the method and apparatus of this invention to electrolytic cells containing a multiplicity of anodes. Thus the number of anodes per cell may range from 1 to about 200 anodes, preferably from about 2 to about 100 anodes.

It is preferred, particularly on a commercial scale, to adjust anode sets when adjusting the space between the anodes and cathode of electrolytic cells. An anode set may contain a single anode, but it is preferred to include from 2 to about 20 anodes, and preferably from about 3 to about 12 anodes per anode set. Voltage and current measurements are obtained for each conductor for each row of anode posts of each anode set in each cell.

When each anode set, such as anode set 12, is initially connected in an electrolytic cell *3a*, which is operated by the method and apparatus of this invention, anode set 12 is lowered to a point where the bottoms of anodes 13 are about 3 millimeters above the mercury cathode. In addition, a set point for the standard voltage coefficient, S, for each conductor 15 is entered into the program of automatic control unit 6. This set point voltage coefficient and subsequent measurements of voltage coefficients, Vc, are calculated according to the formula:

$$Vc = \frac{V - D}{KA/M^2}$$

where V is the measured voltage across an anode set, for example, from terminal 20 on conductor 15 of anode set 12 to terminal 22 on conductor 19, D is the decomposition voltage for the electrolysis being conducted, and $KA/M^2$ is the current density in kiloamperes per square meter of cathode surface below anode set 12. In the electrolysis of sodium chloride in a mercury cell for producing chlorine, the value for D is about 3.1.

Standard or set-point voltage coefficient, S, may vary with a number of factors such as the material of construction of the anode (graphite or metal), the form and condition of the anodes (blocks of graphite which are slotted or drilled, metal mesh or rods coated with a noble metal or oxide) and the location of the anode set in the cell, among other factors. As indicated in "Intensification of Electrolysis in Chlorine Baths with a Mercury Cathode", *The Soviet Chemical Industry*, No. 11, Nov., 1970, pp. 69–70, the standard voltage coefficient (K or S) was found to vary as follows:

| K, standard voltage coefficient, V/kA | Condition |
|---|---|
| 0.55 | no device for regulating anode position |
| 0.3 | use of device for lowering anode |
| 0.2 | intensive perforation of the anodes |
| 0.14 | increased perforation of the anodes |
| 0.09 | use of titanium anodes with ruthenium dioxide coating |
| 0.022 | anodes specially placed in the amalgam |

When the anode set is comprised of metal anodes having a titanium distributor with an anodic surface formed of small parallel spaced-apart titanium rods coated with an oxide of a platinum metal secured to the bottom of the distributor, a standard voltage coefficient ranging from about 0.09 to about 0.13 is entered as the set-point into the program of automatic control unit 6. A deviation, *k* which is the permissable range of deviation from S, is also entered into the program. Generally, *k* varies from about 0.1 to about 10, and preferably from about 2 to about 8 percent of S.

After positioning anode set 12 as described above and entering the values for S and *k* into the program, anode set 12 is lowered a small predetermined distance, from about 0.05 to about 0.5, and preferably from about 0.15 to about 0.35 mm. Then two electrical signals are generated and measured for each conductor 15 of anode set 12. One electric signal corresponds to the current flow in conductor 15 for anode set 12, and may be obtained by measuring the voltage drop between a plurality of terminals, preferably two (20 and 21) spaced a suitable distance apart along the conductor. The spacing between terminals may vary from about 3 to about 100 inches, but a space of about 30 inches is generally used. The space between terminals should be the same distance for all conductors. It is desirable that the terminals be located laterally in the middle of the conductor, in a straight segment of conductor of uniform dimensions. Current measurements may also be obtained using other well known methods such as by the Hall effect or other magnetic detection devices.

The current signal is compensated for temperature changes in the conductor by thermal resistor 24 embedded or otherwise attached to the section of conductor being used as the source of the current signal.

The other electric signal is the voltage drop which is measured between terminals (20 and 22) on across the anode set. When a multiplicity of cells are controlled by the method and apparatus of this invention, the terminals are on the conductors for the corresponding anode sets of two adjacent cells.

The current signals and the voltage signals for each conductor 15 and anode set 12 are transmitted to automatic control unit 6 as described above in the discussion of FIG. 2. It is preferred to obtain the average of a series of N current measurements and the average of a series of N voltage measurements for each conductor 15 for a predetermined period. For example, automatic control unit 6 is programmed to obtain current measurements and voltage measurements at the rate of from about 10 to about 120, and preferably from about 20 to 60 measurements per second. These measurements are obtained for a period of time ranging from about 1 to about 10, and preferably from about 2 to about 5 seconds. The maximum difference in the current measurements in the series at this position i.e., a gap of at least about 3 mm between the anode and cathode, is determined and utilized as described below in the second current analysis. After the average current measurement and average voltage measurement is obtained for each series of measurements for each conductor 15, the average current measurement and average voltage measurement is obtained for each anode set 12. These average values are then used by automatic control unit 6 to calculate the voltage coefficient for anode set 12 in accordance with the above formula for Vc.

When anode set 12 is initially installed it is generally positioned with a large gap, (about 3 mm. or more) between the bottom of the anodes and the cathode. As a result, the first measured voltage coefficient Vc usually exceeds S by more than deviation k. After this comparison is completed, an electrical signal is transmitted from automatic control unit 6 to motor drive unit 8 to lower anode set 12 a small distance within the ranges described above.

A new voltage coefficient, Vc, is calculated for the new position of the anode set by the same procedure and the resulting voltage coefficient is compared with S. If the new voltage coefficient, Vc exceeds S by more than deviation, *k*, the adjustment procedure is repeated until an anode set position is obtained where voltage coefficient Vc does not vary from S by more than the value of deviation *k*. After anode set 12 is in a position where the voltage coefficient falls within the deviation *k* of value S, the current measurements of conductor 15 for anode set 12 are also analyzed to determined whether the anode is too close to the cathode.

Following a decrease in the anode-cathode spacing to a position where Vc is within predetermined limits, a series of N current measurements for anode set 12 are taken for a predetermined period within the above defined ranges. Each current measurement is compared with the preceding current measurement to determine the amount of current increase, and where the current increase exceeds one of several predetermined limits the anode-cathode spacing is immediately increased a predetermined distance. In the first analysis, if the increase in current between the current measurements made immediately before and immediately after the decrease in anode-cathode spacing is greater than a predetermined limit, the anode-cathode spacing is immediately increased. For example, if the anode set is lowered a distance within the above-defined ranges, for example about 0.3 mm, and an increase in current in excess of a predetermined limit occurs, for example, an increase of more than about 5 percent above the previous current measurement, automatic control unit 6 is programmed to transmit an electric signal to motor drive means 8 to cause the anode-cathode spacing to be immediately increased a distance within the above-defined ranges. If the decrease in anode-cathode spacing is smaller than 0.3 mm, a proportionately smaller increase in current differences is used as a limit to effect raising of the anodes.

In a second current analysis, if anode set 12 has not been raised in the first current analysis, a series of N current measurements are taken for conductors 15 for a predetermined period in the ranges described above to determine the magnitude of current fluctuations. The second current analysis is made based upon the average magnitude of the current fluctuations or differences as determined by any convenient method prior to comparing with a predetermined average difference limit. This average difference limit is determined, for example, by doubling the average difference in the current measurements made in the series N when the anode set was initially installed at a large gap between the anode and cathode of at least about 3 mm. The average difference in current in the series of measurements obtained at the initial position generally ranges from about 0.2 to about 0.4 percent of the current to the anode set in that series and thus the predetermined limit for average current difference in a series N ranges from about 0.4 to about 1.6 percent. The term "average difference" when used in the description and claims to define the magnitude of the current fluctuations is intended to include any known method of averaging differences. For example, in a preferred embodiment a calculation is made for $\Sigma\Delta^2/N$, where $\Delta$ is the difference in current between each successive reading in the series and N is the total number of current measurements taken. If this average difference is greater than the predetermined average difference limit, the anode-cathode spacing is immediately increased a predetermined distance. As an alternate, the average difference may be obtained by the calculation $$\sqrt{\frac{\Sigma\,\Delta^2}{N}}\,.$$

or any other similar statistical technique.

A third current analysis determined from the series N of current measurements is whether the current continues to increase for each measurement during series N during a predetermined time period described above. If the current continues to increase for each measurement, the anode-cathode spacing is immediately increased, for example, to the previous position. The number of measurements and the predetermined time period used in this analysis are within the ranges described above, but are more preferably about 180 measurements in 4 seconds.

The fourth analysis of the current measurements determines whether an increase in current for any two measurements during series N, is greater than a predetermined limit, for example, an increase of about 6–8 percent. If so, the anode-cathode spacing is immediately increased by appropriate an electric signal from automatic control unit 6 to motor drive unit 8.

A fifth current analysis compares each current measurement in the series with the previous current measurement, and if the difference between two successive current measurements exceeds a predetermined limit, the distance between the anode and cathode is increased by transmitting an appropriate electrical signal from automatic control unit 6 to motor drive unit 8. When one current measurement is exceeded by the next successive current measurement in an amount from about 0.5 to about 3 percent, and preferably from about 1 to about 1.5 percent of the prior current measurement, the distance between the anode and cathode is increased as described above.

In a sixth current analysis, if any current measurement exceeds the average bus current for the entire electrolytic cell by a difference ranging from 10 to 50 percent and preferably from about 20 to about 40 percent of the average cell current for the entire electrolytic cell, then anode set is raised a predetermined distance.

If any of the current analyses require raising of the anode set a predetermined distance, a new series of current and voltage measurements are obtained and a new voltage coefficient, Vc, is calculated. If the calculated voltage coefficient is below S by more than deviation, *k*, an electrical signal is transmitted from automatic control unit 6 to motor drive unit 8 to raise anode set 12 a small distance within the ranges described above. If the calculated voltage coefficient is above S by more than deviation *k*, the anode set is lowered a predetermined distance. If the new voltage coefficient is within the limits *k*, then the current analyses are repeated.

After a position is found for anode set 12 where the voltage coefficient is within the above-defined predetermined range and none of the above defined current analysis requires raising anode set 12, it may be retained in this position until subsequent automatic scanning, which is defined more fully below, shows the need for further movement of the anode.

All anode sets in a selected cell may be simultaneously adjusted using the above method. The method of the second current analysis can also be employed to locate in a series of adjacent cells, the cell having the highest amount of current fluctuation.

In a further embodiment of the method of the present invention, all anode sets for all cells in operation are serially scanned periodically by the automatic control unit 6 and the current and voltage readings for each anode set compared with their predetermined value ranges. Where the current reading exceeds the above defined predetermined limits, the anode-cathode spacing is increased. This periodic scan detects current overloads to any anode set on a continuing basis. The automatic control unit requires about three seconds to scan the current and voltage measurements for a group of 58 cells containing about 580 anode sets. Any suitable interval between scans may be selected, for example, intervals of about 1 minute. If during a scan, the anode-cathode spacing for an anode set is increased, the scan is repeated for all anode sets for all operative cells.

A further embodiment of the method of the present invention comprises counting the frequency of change in the anode-cathode spacing for a particular anode set during a predetermined time period and where this frequency exceeds a predetermined number, to remove this anode set from automatic control. This may be indicated, for example, by the sounding of an alarm, activating a light on a control panel or causing a message to be printed out on a reader-printer unit associated with a computer.

If the current analyses indicates that the distance between the anode and cathode must be increased at several successive positions, the anode set is raised to the original starting position and a new standard voltage coefficient, S, is placed in the program of the automatic control unit 6. The new standard voltage coefficient, S is increased a predetermined amount above the initial standard voltage coefficient S. Generally the increase is from about 5 to about 20, and preferably from about 10 to about 15 percent of the initial standard voltage coefficient. The above defined procedure for positioning the anode set based upon voltage coefficient is then repeated until a position is found where the voltage coefficient is within the above defined predetermined range.

Automatic control unit 6, when scanning shows voltage coefficient and current measurements to be within predetermined limits may also provide appropriate electric signals to motor drive unit 8, to lower anode set 12 a predetermined distance, *r*, obtain another set of measurements of current and voltage coefficient and continue lowering anode set incrementally a predetermined distance until the voltage coefficient or current analyses indicates that the anode set should be raised a predetermined distance, *r*. Automatic control unit 6 then provides signals to lower anode set 12 a fraction of *r*, for example one half *r*, and a new set of measurements are obtained. If measurements do not require moving anode set 12 from this position, it is retained here until subsequent scanning shows the need for further adjustment.

The following examples are present to define the invention more fully without any intention of being limited thereof.

EXAMPLE 1

A horizontal mercury cathode cell for electrolyzing aqueous sodium chloride to produce chlorine containing 12 anode sets of 8 graphite anodes per set was equipped with the anode control system of FIG. 2. Current and voltage signals for all 12 anode sets were transmitted simultaneously to automatic control unit 6, a digital computer, for about 5 seconds until about 180 readings of current and of voltage were received for each anode set. The average voltage, current, and the difference between each current reading and the previous current reading was determined by the digital computer for the series of readings. The voltage coefficient was calculated for each anode set according to the formula:

$$Vc = \frac{V - 3.I}{KA/M^2}$$

Anode set 2, with a cathode surface area of 2.4 square meters, was found to have a Vc of 0.128, based on an average voltage of 4.38 and an average current reading of 7.53 kiloamperes. When Vc was compared with its standard coefficient S of 0.115, it was found to have a value above the deviation range *k*, where *k* was ± 0.006. When the coefficient comparison determined the value of Vc was above S by a value greater than *k*, a signal from the computer activated a relay which energized a hydraulic motor to lower anode set 2 to decrease the anode-cathode spacing by 0.3 mm. Following the decrease in anode-cathode spacing, the following sequence of operations were performed:

1. a second set of about 15 measurements of current was taken for anode set 12 only and the difference between each measurement determined.
2. The first analysis compared the initial increase in current after decreasing the anode-cathode spacing with the maximum increase prior to the adjustment and was found to be within the predetermined limits.
3. A second set of about 15 current readings was taken and the second analysis for current fluctuation determined using the formula $\Sigma\Delta^2/N$. The fluctuation was found to fall within the predetermined limit of 0.5 percent.

4. A third analysis showed that the time since lowering the anode had not exceeded a fixed limit.
5. A fourth analysis revealed that the total increase in current did not exceed a predetermined limit of 7 percent.
6. The last reading was found to be larger than the previous reading and steps 3 to 5 were repeated with the same result. The latest reading was then found to be smaller than the previous reading indicating that the current to the anode set has stopped increasing. Readings were then taken for all anode sets on the cell and the Vc calculated for each was found to have a value within 5 percent of the stored value S. No further adjustments were made and the next cell to be adjusted was selected.

EXAMPLE 2

A group of horizontal mercury cathode cells for the electrolysis of sodium chloride were employed in this Example, each cell containing 10 anode sets, and each anode set contained 5 anodes. The anodes were constructed of titanium metal and partially coated with a noble metal compound. Each anode set was supplied with current by two conductors. The anode adjustment system of FIG. 2 was installed on the cells. Upon selection of one cell for possible adjustment of the anode-cathode spacing, a series of 180 readings were taken simultaneously for all anode sets in the cell over a period of about 5 seconds. The current measurement was obtained by measuring the voltage drop between two terminals spaced 30 inches apart on each conductor and the voltage measurement was obtained between two corresponding terminals on each conductor supplying current to the corresponding anode set for the next adjacent cell. Thus, a group of 180 current measurements and 180 voltage measurements were obtained for each of the two conductors supplying an anode set and for all ten sets in the cell. Each group of measurements were signal conditioned and converted from analog to digital form and supplied to automatic control unit 6, a digital computer, where the average current and voltage measurements were calculated and average total noise determined by summing the square of the difference between successive readings to each conductor and then averaging the 20 values for the cell. The voltage coefficient was calculated from the average current and voltage readings obtained and then compared with a predetermined standard individually selected for each of the anode sets. Measurements of current and voltage taken for each set of anodes along with the calculated Vc and the predetermined standard Vc are given in Table I. From these results, it can be seen that none of the anode sets fell outside of the limits of k and therefore no adjustment of the anode-cathode spacing was required.

TABLE I

| Anode Set No. | Current in Kiloamperes | | Voltage | | Calculated Vc | Standard S |
|---|---|---|---|---|---|---|
| | Conductor A | Conductor B | Conductor A | Conductor B | | |
| 1 | 6.86 | 6.38 | 4.44 | 4.47 | 0.154 | 0.150 |
| 2 | 7.15 | 7.93 | 4.41 | 4.55 | 0.137 | 0.130 |
| 3 | 7.71 | 7.92 | 4.44 | 4.48 | 0.131 | 0.130 |
| 4 | 7.40 | 7.74 | 4.46 | 4.48 | 0.136 | 0.130 |
| 5 | 7.51 | 7.44 | 4.46 | 4.48 | 0.138 | 0.130 |
| 6 | 7.88 | 7.31 | 4.46 | 4.51 | 0.137 | 0.130 |
| 7 | 7.47 | 7.47 | 4.48 | 4.46 | 0.137 | 0.130 |
| 8 | 7.25 | 7.75 | 4.48 | 4.47 | 0.137 | 0.130 |
| 9 | 7.57 | 7.38 | 4.41 | 4.48 | 0.135 | 0.130 |
| 10 | 6.96 | 6.16 | 4.41 | 4.40 | 0.149 | 0.140 |

Average Anode Set Current — 14.72 KA
Average Cell Voltage — 4.46
k = ±0.010

EXAMPLE 3

Example 2 was repeated using a horizontal mercury cathode cell having graphite anodes. Table II shows the current and voltage measurements and the calculated Vc and standard S voltage coefficients. Deviation range *k* was ±0.010. These results show no adjustment of the anode spacing for any of the 10 anode sets was required.

TABLE II

| Anode Set No. | Current in Kiloamperes | | Voltage | | Calculated Vc | Standard S |
|---|---|---|---|---|---|---|
| | Conductor A | Conductor B | Conductor A | Conductor B | | |
| 1 | 5.93 | 5.55 | 4.93 | 5.00 | .244 | .244 |
| 2 | 7.44 | 7.35 | 4.92 | 4.95 | .186 | .188 |
| 3 | 8.35 | 8.51 | 4.91 | 4.95 | .163 | .168 |
| 4 | 8.10 | 7.63 | 4.91 | 5.02 | .178 | .179 |
| 5 | 7.90 | 7.85 | 4.90 | 4.92 | .172 | .180 |
| 6 | 7.80 | 7.98 | 4.89 | 4.91 | .171 | .175 |
| 7 | 8.09 | 7.66 | 4.89 | 4.89 | .170 | .169 |
| 8 | 7.31 | 7.37 | 4.91 | 4.91 | .185 | .181 |
| 9 | 7.14 | 7.80 | 4.89 | 4.94 | .182 | .179 |
| 10 | 6.40 | 6.76 | 4.89 | 4.90 | .205 | .198 |

Average Anode Set Current — 14.89 KA
Average Cell Voltage — 4.92
k = ±0.010

In Example 3, as well as Example 2, electric motors were used as the motor drive means which received electric signals from the digital computer to adjust the anodes when necessary.

What is desired to be secured by Letters Patent is:

1. In an electrolytic cell having at least one adjustable anode set, at least one conductor conveying electric current to said at least one anode set, and a liquid cathode in spaced relation to said at least one anode set, the improvement which comprises employing, with said electrolytic cell, apparatus for adjusting the space between said at least one anode set and said liquid cathode, which comprises:

a. digital computer means programmed with a standard voltage coefficient and a permissible range of deviation for each anode set, b. means for detecting voltage signals and current signals to each of said anode sets, c. means for selecting from said detected signals a set of signals generated from a selected anode set, d. means for supplying said selected signals in digital form to said digital computer means, e. said digital computer being programmed for calculating the voltage coefficient from said detected signals in digital form for said selected anode set and comparing said voltage coefficient with said permissible range, f. said digital computer being programmed for generating activating electric signals when said calculated voltage coefficient is outside of said permissible range, and g. motor means operative to raise and lower said selected anode set, said motor means being energized by said activating electric signals when said calculated voltage coefficient is outside of said permissible range.

2. The cell of claim 1 wherein said anode sets are comprised of a plurality of said adjustable anode sets, and said voltage coefficient is calculated in accordance with the formula:

$$\text{Voltage coefficient} = \frac{V - D}{KA/M^2}$$

where V is the overall average voltage across said anode set in which said set of signals is generated, D is the decomposition voltage of the cell, and $KA/M^2$ is the current density in kiloamperes per square meter of cathode surface below said selected anode set.

3. The cell of claim 2 wherein there is a plurality of said conductors to each of said anode sets, and said voltage coefficient is calculated by obtaining an average current measurement and an average voltage measurement for a series of measurements for each of said conductors and the average current and average voltage for each anode set is obtained from the average of the average current measurement and average voltage measurement for each of said conductors.

4. The cell of claim 3 wherein said apparatus also comprises a. means for detecting voltage signals and current signals to each anode set and conveying said signals in direct current, analog form at cell potential to a cell selector means, b. an anode selector means for selecting a series of voltage signals and a series of current signals from a selected anode set in said cell selector means, c. means for converting said signals from direct current form to alternating current form, d. transformer means for transforming said signals from cell potential to earth potential, e. detector means to convert said earth potential signals from alternating current to direct current form, f. integrator means to remove electrical noise from direct current earth potential signals, and g. converter means to convert said direct current, earth potential signals from analog form to binary form and for conveying said converted signals to said digital computer.

5. The cell of claim 4 wherein said cell is one of a plurality of said cells in series.

6. Cell of claim 5 wherein said apparatus also comprises a. means for compensating said current signals for temperature variations in said conductors, and b. means for amplifying said signals when detected in said conductors.

7. The cell of claim 6 wherein said transformer means is a transformer.

8. The cell of claim 6 wherein said transformer means is an optical isolator.

9. The cell of claim 6 wherein said apparatus also comprises a. digital computer means being programmed with a standard predetermined current deviation range for each of said conductors to said anode set, b. means for detecting current signals to each of said current conductors of each of said anode sets, c. means for selecting from detected current signals a desired series of N current signals for a selected conductor for a selected anode set, d. means for supplying said selected current signals in digital form to said digital computer means, e. said digital computer being programmed to provide means to compare said selected current signals with said predetermined current deviation range for said conductor to said anode set, f. said digital computer being programmed to provide means to generate an activated electric signal when any of said current signals in said series N is outside of said predetermined deviation range, and g. motor drive means operative to receive said activating electric signals and to raise or lower said selected anode set when said selected current signals are outside of said predetermined current deviation range.

* * * * *